US010190548B2

(12) United States Patent
Arai

(10) Patent No.: US 10,190,548 B2
(45) Date of Patent: Jan. 29, 2019

(54) HEAT SHIELDING STRUCTURE FOR INTAKE SYSTEM FOR ENGINE OF MOTORCYCLE

(71) Applicant: Kawasaki Jukogyo Kabushiki Kaisha, Kobe-shi, Hyogo (JP)

(72) Inventor: Kozo Arai, Kobe (JP)

(73) Assignee: KAWASAKI JUKOGYO KABUSHIKI KAISHA (JP)

( * ) Notice: Subject to any disclaimer, the term of this patent is extended or adjusted under 35 U.S.C. 154(b) by 60 days.

(21) Appl. No.: 15/277,447

(22) Filed: Sep. 27, 2016

(65) Prior Publication Data

US 2017/0101969 A1 Apr. 13, 2017

(30) Foreign Application Priority Data

Oct. 8, 2015 (JP) ..... 2015-200129

(51) Int. Cl.

| | |
|---|---|
| ***F02M 35/10*** | (2006.01) |
| ***F02D 9/02*** | (2006.01) |
| ***F02M 35/024*** | (2006.01) |
| ***F02M 35/16*** | (2006.01) |
| ***F02M 53/04*** | (2006.01) |
| ***F02B 77/11*** | (2006.01) |

(52) U.S. Cl.

CPC ..... *F02M 35/10268* (2013.01); *F02B 77/11* (2013.01); *F02D 9/02* (2013.01); *F02M 35/024* (2013.01); *F02M 35/162* (2013.01); *F02M 53/046* (2013.01); *F02D 2009/0206* (2013.01)

(58) Field of Classification Search

CPC ..... F02M 35/10268; F02M 35/024; F02M 35/162; F02M 35/10085; F02M 35/10262; F02M 35/10255; F02M 35/10249; F02M 35/10242; F02M 35/10373; F02D 9/02

USPC ..... 123/434

See application file for complete search history.

(56) References Cited

U.S. PATENT DOCUMENTS

| | | | | |
|---|---|---|---|---|
| 3,907,606 | A * | 9/1975 | Chang | G01K 1/143 136/233 |
| 6,438,949 | B1 * | 8/2002 | Nozaki | B60K 13/04 123/184.21 |
| 7,370,625 | B2 * | 5/2008 | Hanafusa | F02B 61/02 123/198 E |
| 7,708,099 | B2 * | 5/2010 | Oodachi | B62K 11/04 180/229 |
| 2004/0168654 | A1 * | 9/2004 | Radtke | B60K 15/063 123/2 |
| 2005/0076892 | A1 * | 4/2005 | Nakamura | F02M 25/06 123/572 |
| 2006/0219221 | A1 * | 10/2006 | Tsuruta | B62K 5/01 123/469 |
| 2007/0045028 | A1 * | 3/2007 | Yamamoto | B62J 99/00 180/282 |

(Continued)

FOREIGN PATENT DOCUMENTS

| | | |
|---|---|---|
| JP | 2009-241820 | 10/2009 |

*Primary Examiner* — David Hamaoui
*Assistant Examiner* — Susan Scharpf

(57) ABSTRACT

A cylinder of an engine of a motorcycle is tilted frontward. A throttle unit is provided above the cylinder, and a heat shielding sheet is provided between the cylinder and the throttle unit. The throttle unit includes a fuel injection device, and the heat shielding sheet extends between the fuel injection device and the cylinder.

10 Claims, 8 Drawing Sheets

(56) References Cited

U.S. PATENT DOCUMENTS

2008/0216794 A1* 9/2008 Kuji ..... F02D 9/106
123/336
2009/0242312 A1* 10/2009 Oshima ..... B62J 6/18
180/312
2010/0078239 A1* 4/2010 Beloy ..... B60K 13/02
180/68.3
2010/0187383 A1* 7/2010 Olsen ..... F01N 13/1805
248/201
2012/0006294 A1* 1/2012 Wolanyk ..... F02M 35/10268
123/184.21
2013/0192912 A1* 8/2013 Shimomura ..... F02M 35/02416
180/68.3
2014/0102818 A1* 4/2014 Hirukawa ..... F02M 35/162
180/68.3
2014/0131128 A1* 5/2014 Schuhmacher ..... B62J 17/04
180/219
2016/0250918 A1* 9/2016 Koyama ..... F02M 35/10013
180/68.3

* cited by examiner

HEAT SHIELDING STRUCTURE FOR INTAKE SYSTEM FOR ENGINE OF MOTORCYCLE

CROSS REFERENCE TO THE RELATED APPLICATION

This application is based on and claims Convention priority to Japanese patent application No. 2015-200129, filed Oct. 8, 2015, the entire disclosure of which is herein incorporated by reference as a part of this application.

BACKGROUND OF THE INVENTION (Field of the Invention)

The present invention relates to a heat shielding structure for an intake system for an engine of a motorcycle in which a cylinder is tilted frontward.

(Description of Related Art)

In a motorcycle equipped with an engine in which a cylinder is tilted frontward, a throttle unit which is a portion of an intake system is often disposed above and rearward of the cylinder (e.g., JP Laid-open Patent Publication No. 2009-241820). Since the temperature of the cylinder becomes high, the necessity for protecting the throttle unit from heat of the cylinder may arise depending on a cooling structure for the engine, the structure of a cowling or fairing, or the like. As an example of protecting a throttle body from radiation heat of an exhaust pipe, in JP Laid-open Patent Publication No. 2009-241820, a heat insulating plate is disposed between the exhaust pipe and the throttle body.

The heat insulating plate in JP Laid-open Patent Publication No. 2009-241820 is composed of a sheet metal and is connected to a motorcycle frame structure by means of bolts. However, since many components are disposed around the engine, it may be difficult to ensure a space for installing such a heat insulating plate. In addition, since the plate is mounted to the motorcycle frame structure, change of the design of the motorcycle frame structure is necessary, and the structure of the motorcycle frame structure is also rendered to be complicated.

DISCLOSURE OF THE INVENTION

It is an object of the present invention to provide a heat shielding structure for an intake system for an engine of a motorcycle which is able to protect a throttle unit from heat of the engine with a simple structure.

In order to achieve the above-described object, a heat shielding structure for an intake system for an engine of a motorcycle according to the present invention is a heat shielding structure for an intake system for an engine of a motorcycle in which a cylinder is directed frontward, and includes: a throttle unit provided above the cylinder; and a heat shielding sheet provided between the cylinder and the throttle unit. The throttle unit includes at least a throttle body having a throttle valve therein, and a sensor provided to the throttle body. The heat shielding sheet is a heat insulating sheet made of a resin such as silicone rubber and an aluminum glass cloth. Here, the cylinder includes a cylinder main body or cylinder block and a cylinder head. In addition, "tilted frontward" means that, in a side view, the axis of the cylinder extends frontward from the axis of a crankshaft and is tilted upward or downward at 45° or less with respect to the engine or horizontal line.

According to this configuration, since the heat shielding sheet is provided between the cylinder and the throttle unit, the throttle unit is protected from heat of the engine. Furthermore, since the heat shielding sheet is merely interposed between the cylinder and the throttle unit, it is easy to ensure a space for installing the heat shielding sheet, and it is not necessary to change a motorcycle frame structure. As a result, the structure is simple.

In the present invention, preferably, the throttle unit includes a fuel injection device, and the heat shielding sheet extends between the fuel injection device and the cylinder. According to this configuration, the fuel injection device for which countermeasures for temperature are required can be effectively insulated from heat.

In the present invention, preferably, the throttle unit includes a throttle body having a throttle valve therein; a sensor provided to the throttle body; and an intake pipe that connects the throttle body and an intake port of the engine, and the heat shielding sheet is fitted to the intake pipe. According to this configuration, the sensor for which countermeasures for temperature are required can be effectively insulated from heat, and mounting and positioning of the heat shielding sheet is easy.

In the case where the heat shielding sheet is fitted to the intake pipe, the heat shielding structure preferably further includes a rotation prevention mechanism configured to prevent the heat shielding sheet from rotating relative to the intake pipe. According to this configuration, the heat shielding sheet can be prevented from rotating relative to the intake pipe. The rotation prevention mechanism can be realized, for example, by inserting an electric wire, a cramp member or the like through the heat shielding sheet.

In the present invention, the heat shielding structure preferably further includes an air cleaner configured to clean intake air and provided above the cylinder, in which case a front end portion of the heat shielding sheet is close to or in the vicinity of a lower portion of the air cleaner. According to this configuration, a gap between the heat shielding sheet and the air cleaner is rendered to be small, and therefore, hot air from the cylinder can be prevented from moving toward the throttle unit during idling. In addition, incoming wind is blocked by the air cleaner, and can be prevented from colliding directly against the heat shielding sheet. Therefore, displacing the heat shielding sheet by the incoming wind can be avoided.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF EMBODIMENTS

Hereinafter, preferred embodiments of the present invention will be described with reference to the drawings. In this specification, the terms "left side" and "right side" are the left side and the right side, respectively, as viewed from a rider riding a motorcycle.

Figure 1:
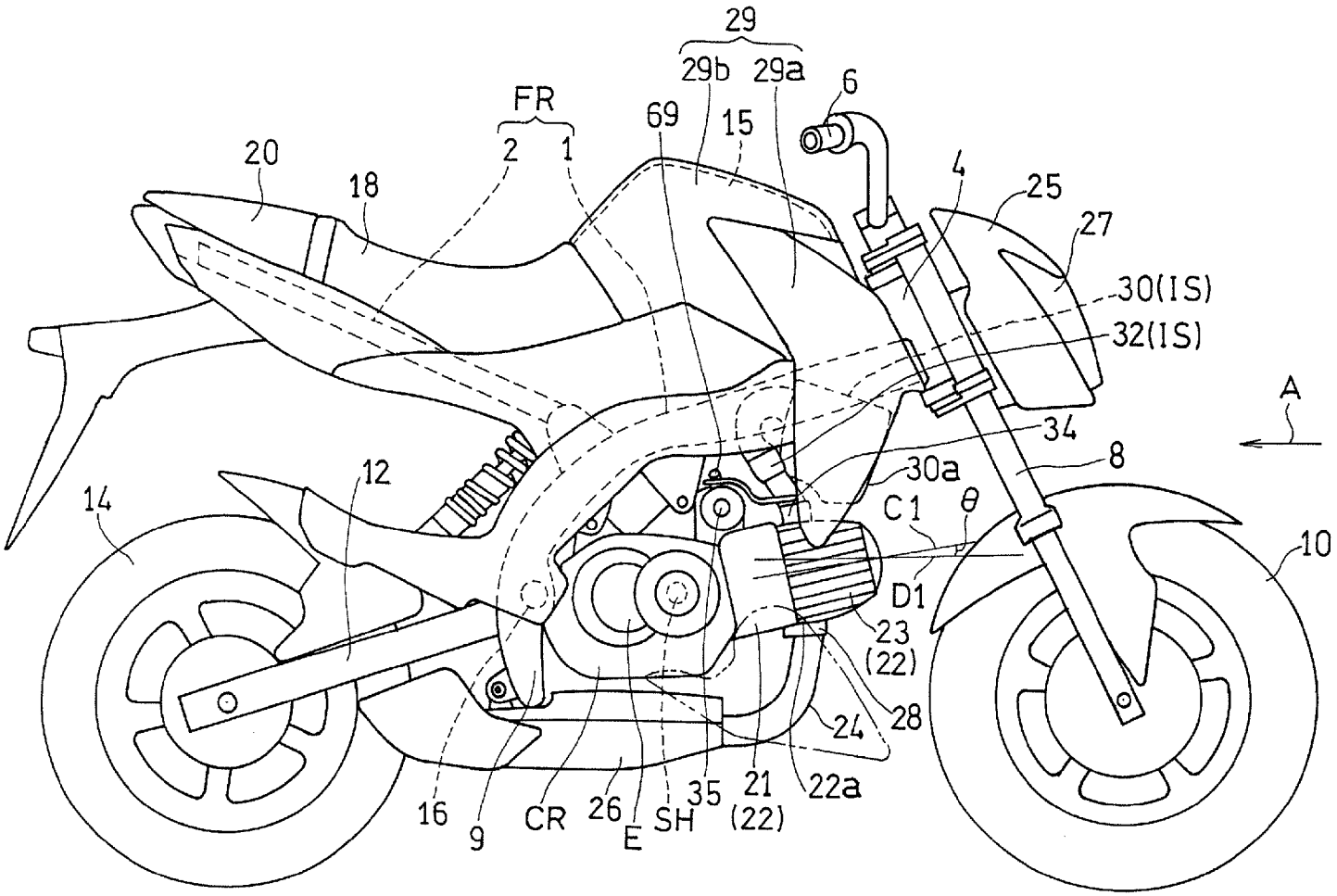
FIG. 1 is a side view showing a motorcycle equipped with an engine including a heat shielding structure for an intake system according to a first embodiment of the present invention.

FIG. 1 is a side view of a motorcycle equipped with an engine including a heat shielding structure for an intake system according to a first embodiment of the present invention. A motorcycle frame structure FR for the motorcycle includes a main frame 1 that forms a front half of the motorcycle frame structure FR, and a rear frame 2 that forms a rear half of the motorcycle frame structure FR. A head pipe 4 is provided at a front end of the main frame 1, and a front fork 8 is rotatably supported by the head pipe 4 through a steering shaft (not shown). A steering handle 6 is fixed to an upper end portion of the front fork 8, and a front wheel 10 is fitted to a lower end portion of the front fork 8.

A swingarm bracket 9 is provided at a rear end portion of the main frame 1. A swingarm 12 is supported by the swingarm bracket 9 for swing movement in a vertical direction about a pivot shaft 16 that is mounted to the swingarm bracket 9. A rear wheel 14 is rotatably supported by a rear end portion of the swingarm 12.

An engine E is fitted to a lower portion of the main frame 1 at the front side of the swingarm bracket 9. The engine E drives the rear wheel 14 through a drive chain (not shown). In the present embodiment, the engine E is an air-cooled single-cylinder engine. However, the type of the engine E is not limited thereto.

A cylinder 22 of the engine E of the present embodiment is disposed so as to be tilted frontward. That is, the cylinder 22 is mounted on a crankcase CR, which supports a rotation shaft SH of the engine E, so as to be tilted frontward. The cylinder 22 includes a cylinder main body or cylinder block 21 having a cylinder bore in which a piston slides and a cylinder head 23 connected to a top portion of the cylinder main body 21. Here, "tilted frontward" means that, in a side view, the cylinder 22 extends frontward from the rotation shaft SH of the engine E and is tilted upward or downward at 45° or less with respect to the engine E, that is, a tilt angle θ of a cylinder axis C1 with respect to a front-rear direction or longitudinal direction D1 of the motorcycle is not greater than 45°. The tilt angle θ is more preferably not greater than 30°. In the present embodiment, the tilt angle θ is set to approximately 10°.

An exhaust pipe 24 is connected to an exhaust port 28 at a lower surface 22*a* of the cylinder 22. The exhaust pipe 24 is connected to an exhaust muffler 26 that is disposed below the engine E. An air cleaner 30 and a throttle unit 32 are provided above the cylinder 22 and aligned in the front-rear direction such that the air cleaner 30 is located frontward of the throttle unit 32. The air cleaner 30 purifies intake air and discharges the intake air to the throttle unit 32. The throttle unit 32 controls the amount of the intake air from the air cleaner 30 and discharges the intake air to an intake port 34 at an upper portion of the cylinder 22. The air cleaner 30 and the throttle unit 32 cooperate together to form an intake system IS for the engine E.

A starter motor 35 that starts up the engine E is disposed rearward of the intake system IS for the engine E and above the engine E, and is supported by the engine E. A connector portion 69 for electric connection is provided on an upper portion of the starter motor 35 so as to project upward. An electric wire 69*a* for starter motor control (FIG. 6) is connected to the connector portion 69. The electric wire 69*a* is connected to, for example, an electronic control unit (ECU) via a main harness (not shown).

A fuel tank 15 is disposed on an upper portion of the main frame 1, and a rider's seat 18 and a passenger's seat 20 are supported by the rear frame 2. In addition, a front fairing 25 made of a resin is disposed at a vehicle body front portion, specifically, frontward of the front fork 8, and a headlamp 27 is mounted on the front fairing 25. A pair of right and left shroud/tank covers 29 made of a resin are disposed rearward of the front fairing 25, more specifically, rearward of the front fork 8. Each shroud/tank cover 29 includes a shroud portion 29*a* that covers the intake system IS from an outer lateral side and a tank cover portion 29*b* that covers a side portion of the fuel tank 15.

During travelling, incoming wind A that has passed through an area above the front wheel 10 and below the front fairing 25 collides against the cylinder 22 of the engine E to cool the cylinder 22. In addition, a front surface 30*a* of the air cleaner 30 is tilted rearward toward the lower side. Therefore, the incoming wind A that has collided against the front surface 30*a* of the air cleaner 30 is downwardly guided to the cylinder 22. Accordingly, an effect of cooling the cylinder 22 improves.

Figure 2:
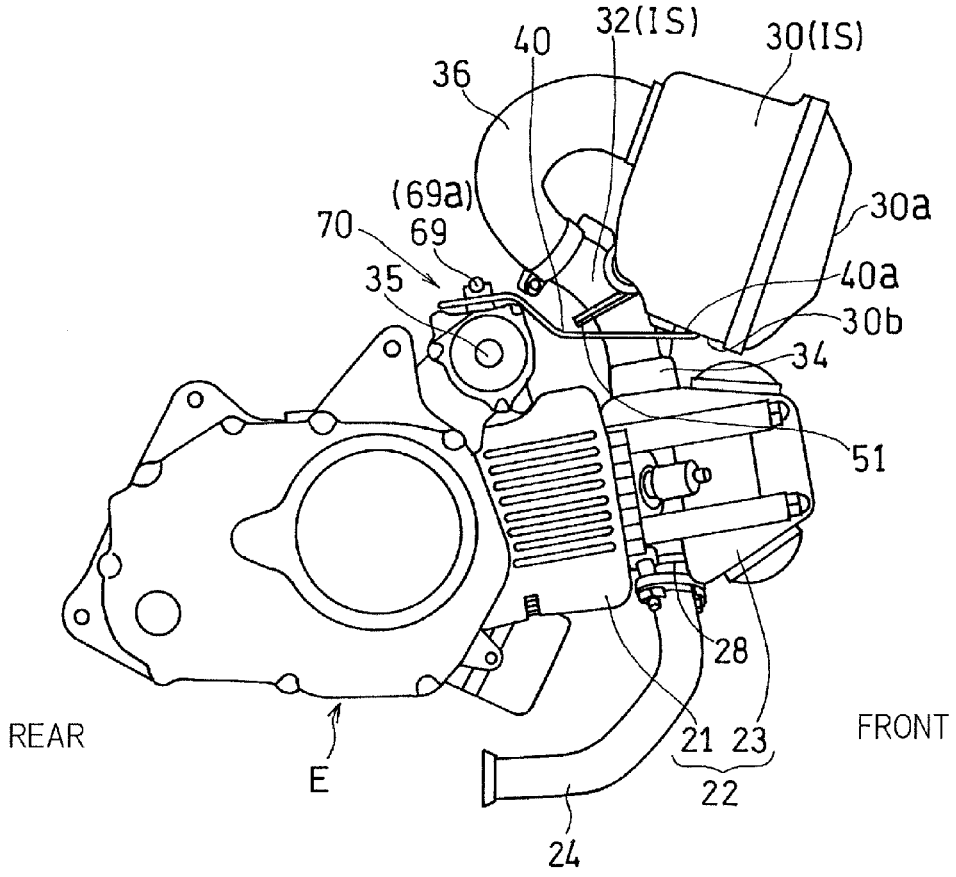
FIG. 2 is a side view showing a main part of the motorcycle.

As shown in FIG. 2, an outlet of the air cleaner 30 and an inlet of the throttle unit 32 are connected to each other via an intake pipe 36, and an outlet of the throttle unit 32 is connected to the intake port 34. A heat shielding sheet 40 is disposed between the cylinder 22 and the throttle unit 32. The heat shielding sheet 40 protects the throttle unit 32 from radiation heat of the cylinder 22. The heat shielding sheet 40 is a heat insulating sheet made of a resin. In the present embodiment, the heat shielding sheet 40 is a heat insulating sheet made of silicone rubber and having a thickness of approximately 1 mm. However, the material of the heat shielding sheet 40 is not limited thereto. A front end portion 40*a* of the heat shielding sheet 40 is close to or in the vicinity of a lower portion 30*b* of a front end portion of the air cleaner 30. The lower portion 30*b* extends rearward and upward so as to be tilted upward toward the rear side.

Figure 3:
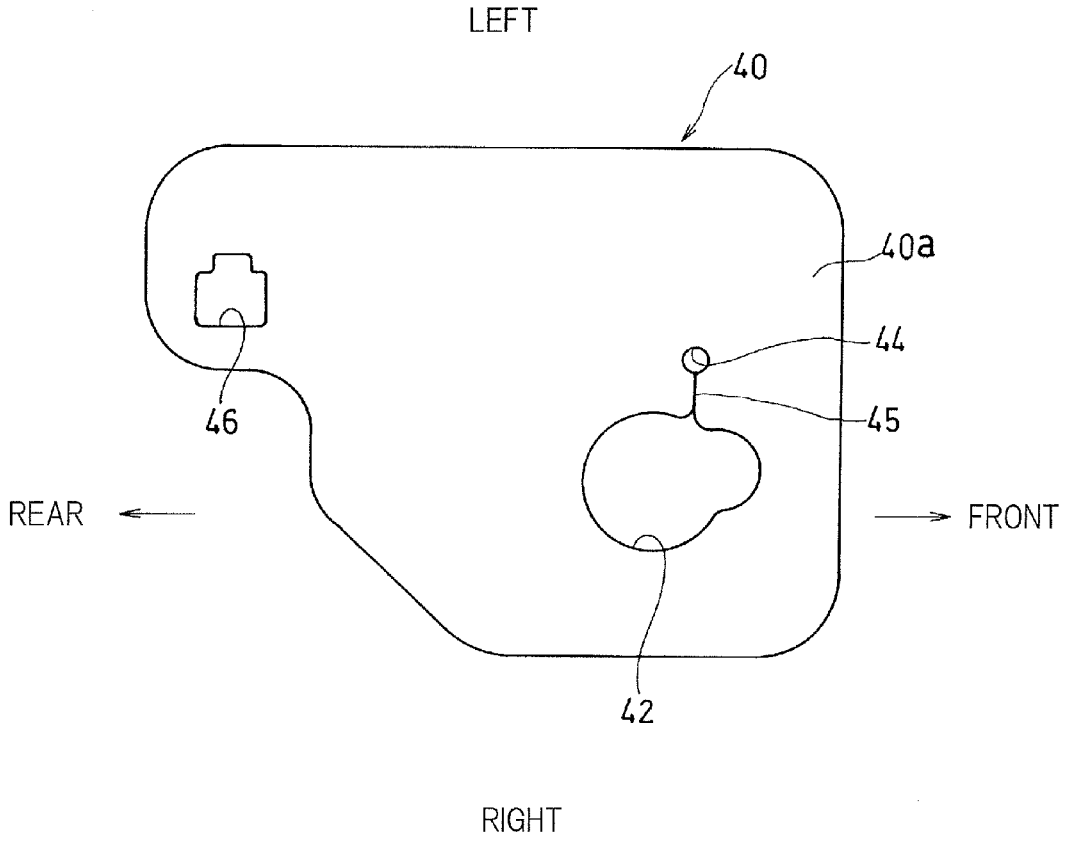
FIG. 3 is a plan view showing a heat shielding sheet of the heat shielding structure.

As shown in FIG. 3, the heat shielding sheet 40 is formed such that a front portion thereof is larger in a vehicle widthwise direction than a rear portion thereof, and an intake pipe insertion hole 42 is formed in the front portion. In addition, a cable insertion hole 44 is formed in the front portion of the heat shielding sheet 40 and lateral to the intake pipe insertion hole 42. A slit (cutout) 45 is formed in the heat shielding sheet 40 and between the intake pipe insertion hole 42 and the cable insertion hole 44. A connector insertion hole 46 is formed in the rear portion of the heat shielding sheet 40.

Figure 4:
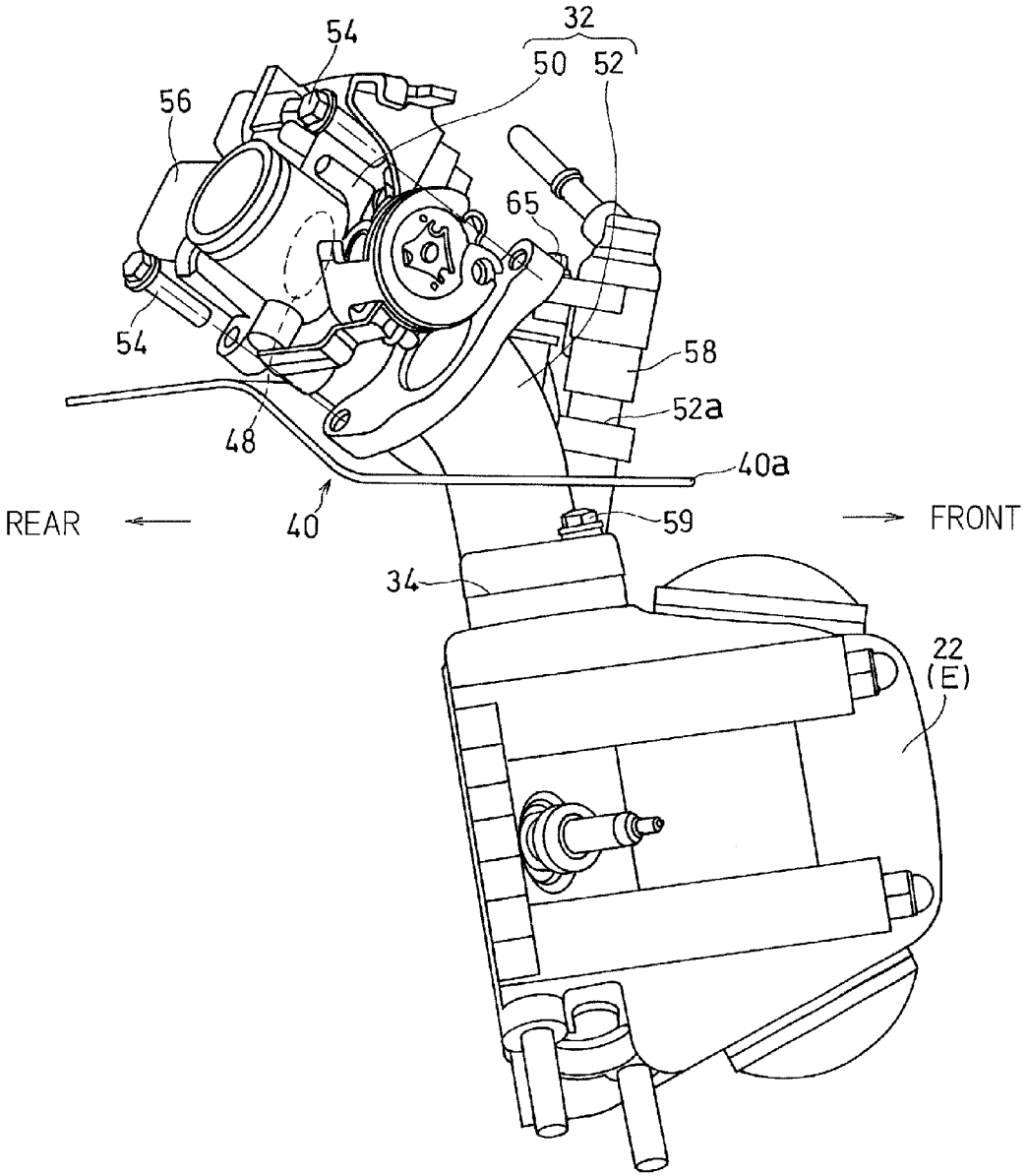
FIG. 4 is a side view showing a throttle unit of the intake system.

As shown in FIG. 4, the throttle unit 32 includes a throttle body 50 in which a throttle valve 48 is provided, and an intake pipe 52 that connects the throttle body 50 and the intake port 34 of the engine E. The throttle body 50 and the intake pipe 52 are connected to each other by means of two bolts 54 to form the throttle unit 32. The intake pipe 52 is connected to the intake port 34 by means of two bolts 59. The throttle body 50 is provided with a sensor unit 56. The sensor unit 56 includes, for example, a throttle position sensor.

A fuel injection device 58 that injects fuel to the intake air is mounted at an injector mounting port 52*a* of the intake pipe 52. The heat shielding sheet 40 is fitted to the intake pipe 52 and extends between the fuel injection device 58 and the cylinder 22. That is, the intake pipe insertion hole 42 (FIG. 3) of the heat shielding sheet 40 has a shape corresponding to the outer shape of the intake pipe 52.

Figure 5:
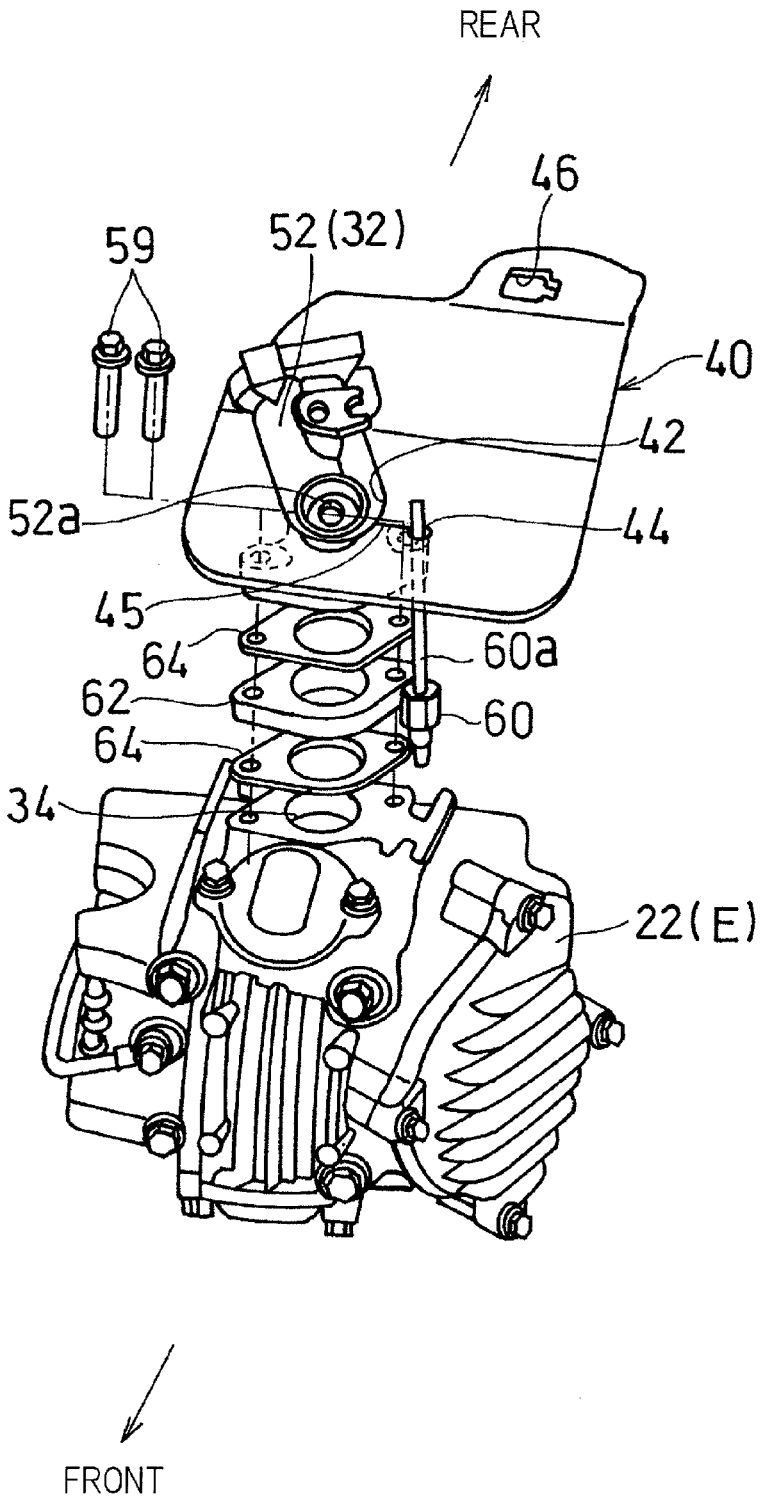
FIG. 5 is an exploded perspective view showing a mounting structure for the throttle unit and the heat shielding sheet.

A mounting structure for the throttle unit 32 and the heat shielding sheet 40 will be described. As shown in FIG. 5, the intake pipe 52 is mounted to the intake port 34 of the cylinder 22 by using the two bolts 59 in a state where the intake pipe 52 is inserted through the intake pipe insertion hole 42 of the heat shielding sheet 40. At this time, a cable 60*a* of an engine temperature sensor 60 is also inserted through the cable insertion hole 44 of the heat shielding sheet 40 beforehand. Since the slit 45 is formed in the heat shielding sheet 40 between the intake pipe insertion hole 42 and the cable insertion hole 44, the mountability of the intake pipe 52 and the cable 60*a* is enhanced. An insulator 62 and two gaskets 64, 64 on both surfaces thereof are interposed between the intake pipe 52 and the intake port 34.

Figure 6:
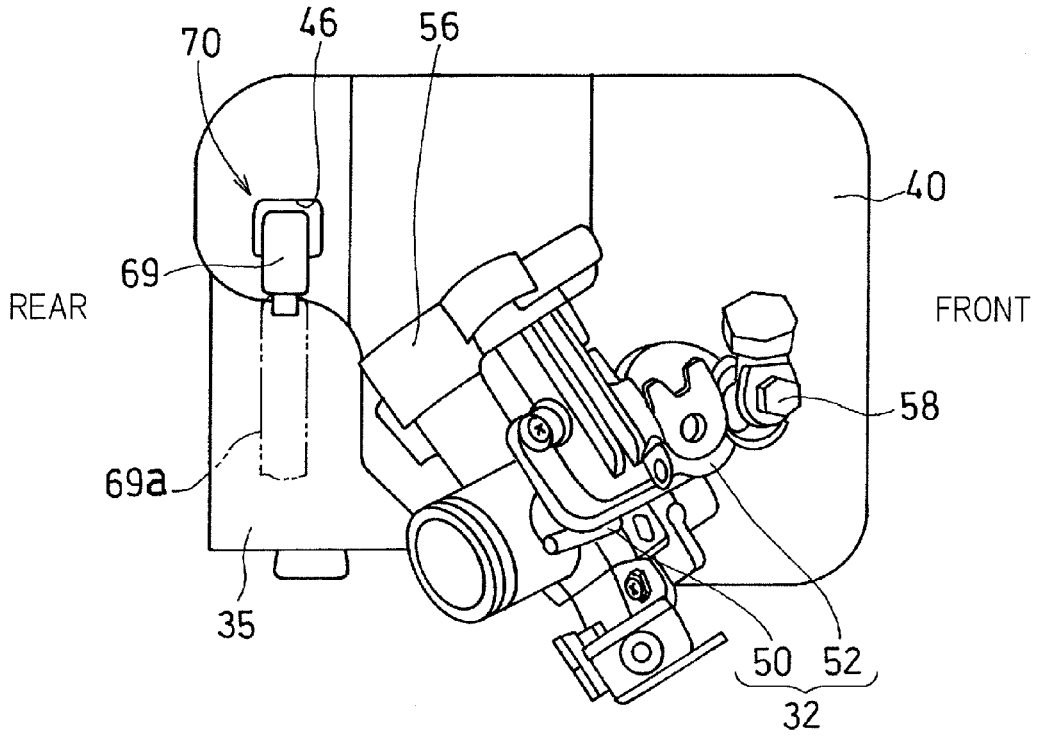
FIG. 6 is a plan view showing the heat shielding structure.

Subsequently, the fuel injection device 58 is mounted to the injector mounting port 52*a* of the intake pipe 52 by using a bolt 65 shown in FIG. 4. Furthermore, the throttle body 50 is connected to the intake pipe 52 by using the bolts 54. Furthermore, as shown in FIG. 6, the connector portion 69 of the starter motor 35 is inserted into the connector insertion hole 46 of the heat shielding sheet 40. Thereafter, the electric wire 69*a* for starter motor control is connected to the connector portion 69.

In the motorcycle according to the present embodiment, as shown in FIG. 1, the throttle unit 32 is disposed above the cylinder 22, which is tilted frontward, and the air cleaner 30 is disposed frontward of the throttle unit 32. Furthermore, the outer lateral sides of the air cleaner 30 and the throttle unit 32 are covered with the right and left shroud portions 29*a*, 29*a*. Thus, the incoming wind A is hard to flow through an area above the cylinder 22 and rearward of the air cleaner 30, and heat of the cylinder 22 is easily trapped in this area.

Figure 7:
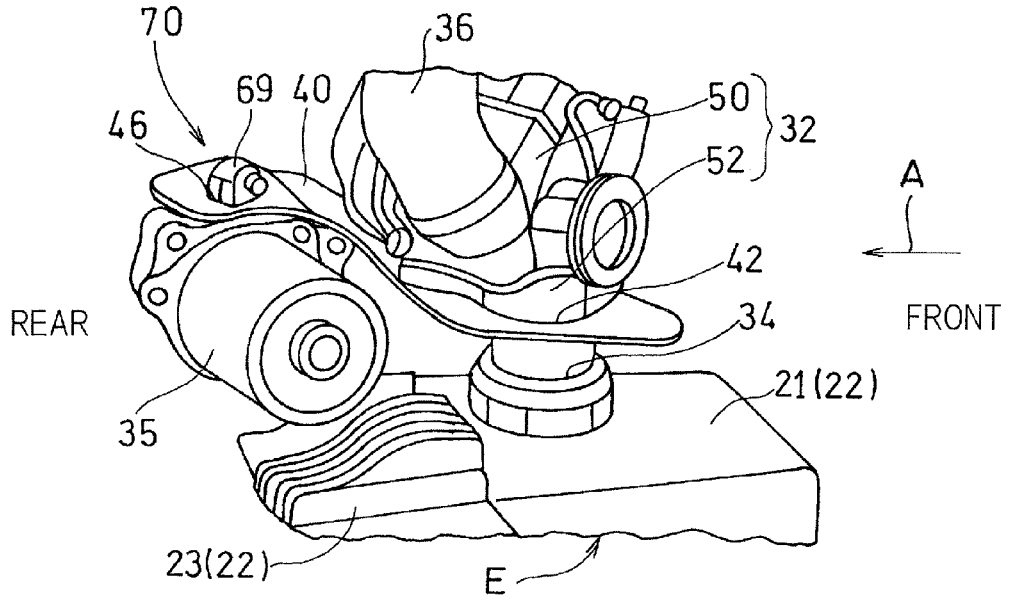
FIG. 7 is a perspective view showing the heat shielding structure.

According to the above configuration, since the heat shielding sheet 40 is provided between the cylinder 22 and the throttle unit 32 as shown in FIG. 7, the throttle unit 32 is protected from the heat of the cylinder 22. In particular, since the heat shielding sheet 40 extends between the sensor unit 56 and the fuel injection device 58 of the throttle unit 32 and the cylinder 22 as shown in FIG. 6, the sensor unit 56 and the fuel injection device 58 for which countermeasures for a temperature rise are required can be effectively protected from the heat of the cylinder 22.

In addition, since the heat shielding sheet 40 made of a resin is merely interposed between the cylinder 22 and the throttle unit 32, it is easy to ensure a space for installing the heat shielding sheet 40, and it is not necessary to change the motorcycle frame structure. Accordingly, the structure is simple. Furthermore, since the heat shielding sheet 40 is a flexible heat insulating sheet made of silicone rubber, the heat shielding sheet 40 can be easily installed in a limited space around the engine E and does not damage other components surrounding the engine E. Specifically, although the heat shielding sheet 40 is disposed such that the rear portion thereof is displaced upward from the front portion thereof as shown in FIG. 7, the heat shielding sheet 40, composed of a flexible heat insulating sheet, can be easily disposed in such a manner.

The heat shielding sheet 40 is tightly fitted to the intake pipe 52 of the throttle unit 32. Therefore, a mounting operation such as bolting is not necessary, and the heat shielding sheet 40 is easily mounted. Furthermore, the cable 60*a* of the temperature sensor 60 is inserted through the cable insertion hole 44 of the heat shielding sheet 40 and the connector portion 69 of the starter motor 35 is inserted through the connector insertion hole 46. Therefore, the heat shielding sheet 40 can be prevented from rotating relative to the intake pipe 52. That is, by inserting the connector portion 69 of the starter motor 35 through the connector insertion hole 46 of the heat shielding sheet 40, a rotation prevention mechanism 70 that prevents the heat shielding sheet 40 from rotating relative to the intake pipe 52 is configured. In addition, since the throttle body 50 is connected to the intake pipe 52 and the electric wire 69*a* is connected to the connector portion 69, the heat shielding sheet 40 does not come off.

The front end portion 40*a* of the heat shielding sheet 40 shown in FIG. 2 is close to the lower portion 30*b* of the air cleaner 30. Thus, the gap between the heat shielding sheet 40 and the air cleaner 30 is rendered to be small, and therefore, hot air from the cylinder 22 can be prevented from moving toward the throttle unit 32 during idling. In addition, since the incoming wind A is blocked by the front surface 30*a* of the air cleaner 30, collision of the incoming wind A directly against the heat shielding sheet 40 to turn up the heat shielding sheet 40 can be avoided.

Furthermore, movement in the vertical direction of the front portion of the heat shielding sheet 40 is restricted by a flange 51 of the intake pipe 52 and the intake port 34, and movement in the vertical direction of the rear portion of the heat shielding sheet 40 is restricted by the starter motor 35 and the electric wire 69*a* connected to the starter motor 35. Therefore, even when vibration occurs during travelling, the heat shielding sheet 40 does not come off.

Figure 8:
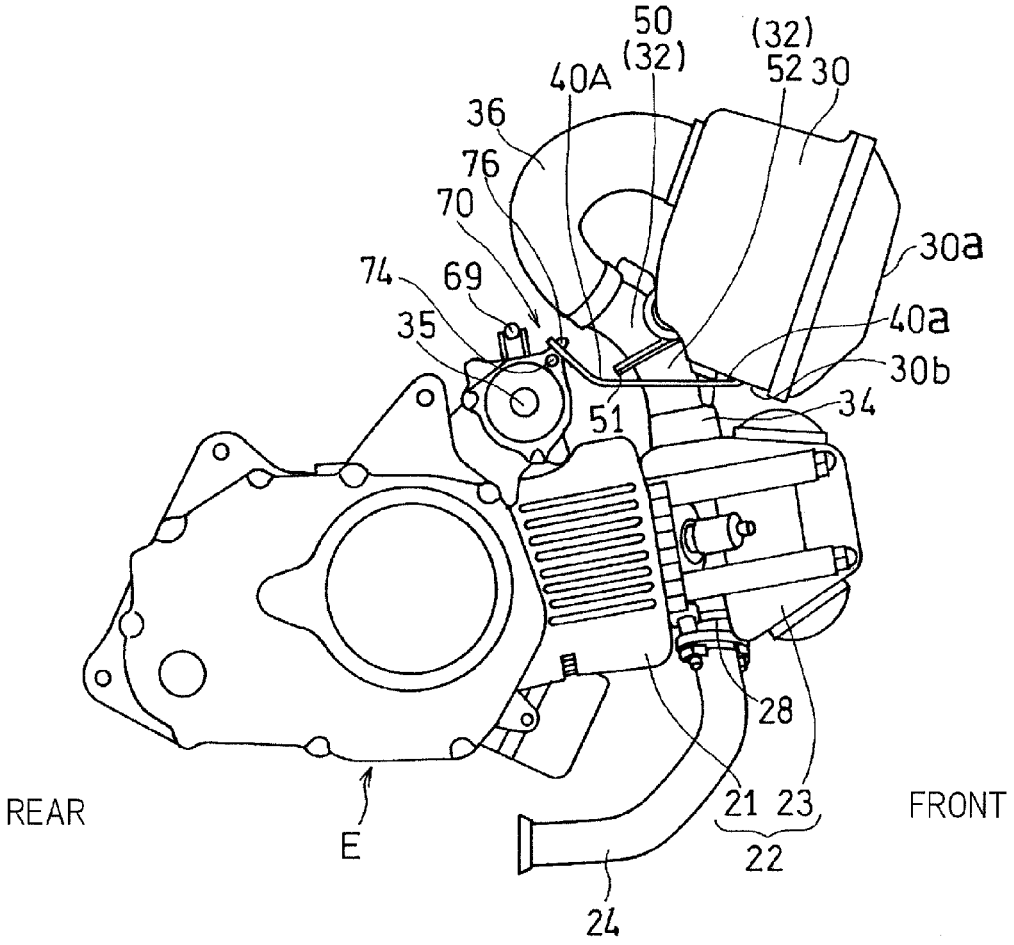
FIG. 8 is a side view showing a main part of a motorcycle equipped with an engine including a heat shielding structure for an intake system according to a second embodiment of the present invention.
Figure 9:
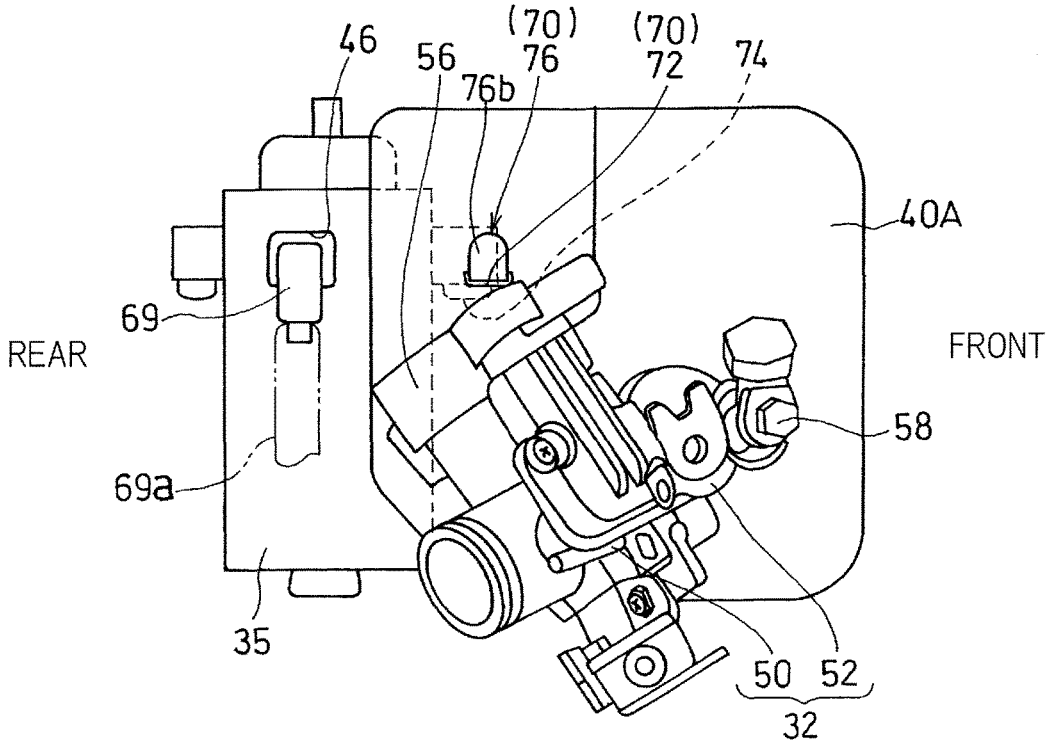
FIG. 9 is a plan view showing the heat shielding structure.

FIG. 8 is a side view showing a main part of a motorcycle equipped with an engine including a heat shielding structure for an intake system according to a second embodiment of the present invention, and FIG. 9 is a plan view showing the heat shielding structure. The second embodiment is different from the first embodiment in the shape and the material of a heat shielding sheet 40A and the configuration of the rotation prevention mechanism 70. Specifically, the heat shielding sheet 40A of the second embodiment is a heat insulating sheet having a thickness of 1 mm and made of an aluminum glass cloth. As shown in FIG. 9, a rear portion of the heat shielding sheet 40A extends to a position covering a front portion of the starter motor 35 from above. A cramp insertion hole 72 is formed in the rear portion of the heat shielding sheet 40A. That is, the heat shielding sheet 40A of the second embodiment does not reach the connector portion 69 of the starter motor 35, and the dimension, in the front-rear direction, of the heat shielding sheet 40A is smaller than that of the heat shielding sheet 40 of the first embodiment.

Figure 10:
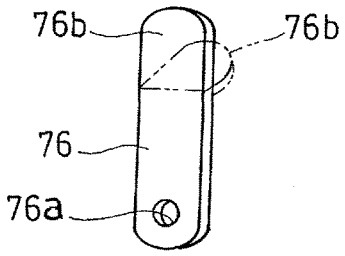
FIG. 10 is a perspective view showing a cramp member of the heat shielding structure.

As shown in FIG. 8, a cramp member 76 extending so as to be tilted upward and slightly frontward is fastened together by a bolt 74 that fixes the starter motor 35 to the engine E. The cramp member 76 is formed by bending a sheet metal, and an insertion hole 76*a* through which the bolt 74 is inserted is formed in a lower end portion of the cramp member 76 as shown in FIG. 10. An upper end portion 76*b* of the cramp member 76 is bendable in the vehicle widthwise direction as shown by a double dotted line.

In the second embodiment, in a state where the front portion of the heat shielding sheet 40A shown in FIG. 8 is fitted to the intake pipe 52, the throttle unit 32 is connected to the intake port 34 of the engine E, and the cramp member 76 is inserted through the cramp insertion hole 72 of the rear portion of the heat shielding sheet 40A shown in FIG. 9. That is, by inserting the cramp member 76 through the cramp insertion hole 72 of the heat shielding sheet 40A, the rotation prevention mechanism 70 that prevents the heat shielding sheet 40A from rotating relative to the intake pipe 52 is configured. After the cramp member 76 is inserted through the cramp insertion hole 72, the upper end portion 76*b* of the cramp member 76 is bent in the vehicle widthwise direction as shown in FIG. 9, thereby restricting upward movement of the rear portion of the heat shielding sheet 40A. The other configuration is the same as in the first embodiment.

In the second embodiment as well, the same advantageous effects as those in the first embodiment are achieved. Furthermore, according to the second embodiment, since the rotation prevention mechanism 70 is configured with the cramp insertion hole 72 of the heat shielding sheet 40A and the cramp member 76 inserted through the cramp insertion hole 72, the flexibility in designing the heat shielding sheet 40A improves. Specifically, the shape of the heat shielding sheet 40A can be changed by providing the cramp member 76 at an arbitrary place. For example, in the second embodiment, the size of the heat shielding sheet 40A can be made smaller than that in the first embodiment. Furthermore, since, instead of an electric wire, the cramp member 76 made of a sheet metal is inserted, it is possible to adopt an aluminum glass cloth having electric conductivity as the heat shielding sheet 40A, and therefore, the degree of freedom in material selection improves.

The present invention is not limited to the embodiments described above, and various additions, changes, or deletions can be made without departing from the gist of the present invention. For example, the materials and the shapes of the heat shielding sheets 40 and 40A are not limited to those in the embodiments described above. In addition, although the fuel injection device 58 is provided at the intake pipe 52 in the embodiments described above, the fuel injection device 58 may be provided at the throttle body 50. Therefore, these are construed as included within the scope of the present invention.

REFERENCE NUMERALS

22 . . . cylinder
30 . . . air cleaner
32 . . . throttle unit
34 . . . intake port
40, 40A . . . heat shielding sheet
50 . . . throttle body
52 . . . intake pipe
58 . . . fuel injection device
60*a* . . . cable (electric wire)
69 . . . connector portion (electric wire)
70 . . . rotation prevention mechanism
E . . . engine
IS . . . intake system

What is claimed is:

1. A heat shielding structure for an intake system for an engine of a motorcycle in which a cylinder is tilted frontward, the heat shielding structure comprising:
a throttle unit provided above the cylinder; and
a heat shielding sheet provided between the cylinder and the throttle unit,
the heat shielding sheet protecting the throttle unit from radiation heat of the cylinder, wherein
the throttle unit includes: a throttle body having a throttle valve therein; a sensor provided to the throttle body; and an intake pipe configured to connect the throttle body and an intake port of the engine,
the heat shielding sheet includes an intake pipe insertion hole through which the intake pipe is inserted, and
the heat shielding sheet extends between the cylinder and the throttle unit, and is configured to block the radiation heat from the cylinder to the throttle unit.

2. The heat shielding structure as claimed in claim 1, wherein
the throttle unit includes a fuel injection device, and
the heat shielding sheet extends between the fuel injection device and the cylinder.

3. The heat shielding structure as claimed in claim 1, further comprising a rotation prevention mechanism configured to prevent the heat shielding sheet from rotating relative to the intake pipe.

4. The heat shielding structure as claimed in claim 3, wherein an electric wire is inserted through the heat shielding sheet.

5. The heat shielding structure as claimed in claim 1, further comprising an air cleaner configured to clean intake air and provided above the cylinder, wherein
a front end portion of the heat shielding sheet is in the vicinity of a lower portion of the air cleaner.

6. The heat shielding structure of claim 3, wherein the rotation prevention mechanism includes providing a connector insertion hole and an intake pipe insertion hole spaced apart on the heat shielding structure for receiving respectively a connector and an intake pipe.

7. A heat shielding structure for an intake system for an engine of a motorcycle in which a cylinder is tilted frontward, the heat shielding structure comprising:
a throttle unit provided above the cylinder; and
a heat shielding sheet provided between the cylinder and the throttle unit,
the heat shielding sheet protecting the throttle unit from radiation heat of the cylinder, wherein
the throttle unit includes a throttle body having a throttle valve and a sensor unit with a throttle position sensor on the throttle body; and
an intake pipe is configured to connect the throttle body and an intake port of the engine, and
the heat shielding sheet is made of a heat insulating resin sheet and has an intake pipe insertion hole spaced apart from a second hole for receiving a connector to prevent rotation of the heat shielding sheet fitted to the intake pipe.

8. The heat shielding structure as claimed in claim 7, wherein
the throttle unit includes a fuel injection device, and
the heat shielding sheet extends between the fuel injection device and the cylinder.

9. The heat shielding structure as claimed in claim 7, wherein an air cleaner is positioned above the cylinder and the heat shielding sheet extends below the air cleaner to direct air, contacting the exterior of the air cleaner to pass under the heat shielding sheet for cooling the motorcycle engine.

10. The heat shielding structure as claimed in claim 9, wherein the width of the front edge of the heat shielding sheet is wider than the rear edge of the heat shielding sheet and is positioned adjacent a lower portion of the front end portion of the air cleaner.

* * * * *